US009215773B2

(12) United States Patent
Lee et al.

(10) Patent No.: US 9,215,773 B2
(45) Date of Patent: Dec. 15, 2015

(54) CONTROL METHODS AND BACKLIGHT CONTROLLERS FOR LIGHT DIMMING

(71) Applicant: Leadtrend Technology Corporation, Hsinchu (TW)

(72) Inventors: Ching-Tsan Lee, Hsinchu (TW); Mao-Shih Li, Hsinchu (TW)

(73) Assignee: LEADTREND TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 14/597,567

(22) Filed: Jan. 15, 2015

(65) Prior Publication Data

US 2015/0216009 A1 Jul. 30, 2015

(30) Foreign Application Priority Data

Jan. 27, 2014 (TW) ..... 103102845 A

(51) Int. Cl.
*H05B 33/08* (2006.01)
*H05B 37/02* (2006.01)

(52) U.S. Cl.
CPC ..... *H05B 33/0845* (2013.01); *H05B 33/083* (2013.01); *H05B 37/0281* (2013.01)

(58) Field of Classification Search
None
See application file for complete search history.

(56) References Cited

U.S. PATENT DOCUMENTS

| | | | | |
|---|---|---|---|---|
| 8,111,013 | B2 * | 2/2012 | Sanchez | H02M 7/53873 315/276 |
| 2002/0153852 | A1 * | 10/2002 | Liao | H05B 41/2824 315/307 |
| 2009/0015179 | A1 * | 1/2009 | Hatano | G09G 3/3406 315/307 |
| 2011/0025230 | A1 * | 2/2011 | Schulz | H05B 33/0818 315/294 |
| 2013/0015781 | A1 * | 1/2013 | Kanemitsu | H05B 33/0815 315/291 |
| 2014/0132172 | A1 * | 5/2014 | Zhu | H05B 37/02 315/210 |
| 2014/0176015 | A1 * | 6/2014 | Suzuki | H05B 33/0803 315/307 |

* cited by examiner

*Primary Examiner* — Crystal L Hammond
(74) *Attorney, Agent, or Firm* — McClure, Qualey & Rodack, LLP

(57) ABSTRACT

A control method is disclosed for light dimming. A dimming condition signal is provided to represent whether a light emitting device is expected to be emitting light. The duration when the dimming condition signal is at a logic value indicating the light emitting device is emitting light is a dimming-ON time, in which a close loop is provided to make a power converter convert electric energy to the light emitting device such that the light emitting device is capable of emitting light. A power-ON time is the duration when the power converter converts electric energy to the light emitting device. When the dimming-ON time ends and is less than a minimum power-ON time, the power converter continues converting the electric energy to the light emitting device so as to keep the power-ON time not less than the minimum power-ON time.

17 Claims, 8 Drawing Sheets

CONTROL METHODS AND BACKLIGHT CONTROLLERS FOR LIGHT DIMMING

CROSS-REFERENCE TO RELATED APPLICATION

This application claims priority to and the benefit of Taiwan Application Series Number 103102845 filed on Jan. 27, 2014, which is incorporated by reference in its entirety.

BACKGROUND

The present disclosure relates generally to control methods and apparatuses for light dimming, and more specifically to backlight controllers and dimming control methods capable of avoiding flickering.

As superior in power-to-light conversion efficiency, product size and device lifespan, light emitting diodes (LEDs) have long being utilized in applications of lighting and backlights. For example, nowadays, the backlight modules, which were used to employ cold cathode fluorescent lamps (CCFLs) as light sources, are commonly employing LED modules.

Circuitry for driving LEDs in a backlight module normally has two stages. The first one is a power converter, which could be a switching mode power supply, for converting and providing electric energy to the LEDs so they could emits light. The second stage is a constant current controller for regulating the amplitude of the current through the LEDs.

Dimming is a common function required for a LED module, as the brightness of a backlight frequently needs adjustment. It is well known in the art that dimming methods are categorized into two ways. One is called PWM dimming or digital dimming, the other analog dimming. PWM dimming uses a digital dimming signal that determines a duty cycle of a LED, or the ratio of the time duration when the LED emits light to the cycle time of the digital dimming signal. Normally, for PWM dimming, when an LED emits light, its light intensity is a constant irrelevant to the duty cycle. Analog dimming uses an analog dimming signal instead to regulate the amplitude of the current flowing through a LED, so it emits light constantly and continuously and its brightness is determined by the analog dimming signal.

A power converter for driving a LED usually utilizes a close loop to regulate an output voltage. This close loop certainly has it limited bandwidth and response time. If the close loop is activated for a duration less than its response time, the power converter, as not having enough time to stabilize the close loop, might provide power energy not as sufficient as that for driving the LED properly. Probably, human eyes might conceive that the LED becomes dark for a while every certain period of time. This phenomenon, also called flickering in the art, is very unpleasant to human eyes and should be avoided.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified. These drawings are not necessarily drawn to scale. Likewise, the relative sizes of elements illustrated by the drawings may differ from the relative sizes depicted.

The invention can be more fully understood by the subsequent detailed description and examples with references made to the accompanying drawings, wherein.

DETAILED DESCRIPTION

In order to prevent flickering, one embodiment of the invention defines a minimum power-ON time, which is the minimum period of time when a power converter continues transferring or providing electric power. In some conditions, the power converter is not allowed to stop providing electric power to a LED module until the end of the minimum power-ON time. In an embodiment, when a LED module stops emitting light, the close loop regulating the electric power that the power converter converts is made open immediately, but the power converter continues transferring electric power until the end of the minimum power-ON time.

Accordingly, in the condition when the digital dimming signal for PWM dimming has a quite short ON time, the power converter will transfer over sufficient power to the LED module and build a sufficient output voltage, so the LED module is capable of emitting light with desired amplitude in subsequent dimming-ON times.

The close loop could be made open for several cycle times of the digital dimming signal. The output voltage, as the close loop no more regulates it, might go over high and triggers the occurrence of an over voltage event. In one embodiment of the invention, once the over voltage event occurs, the power converter is stopped from converting power but the PWM dimming continues.

In one embodiment, a power converter might not be necessary to continue transferring power until the end of the minimum power-ON time. During the time when a LED module emits light, if the output voltage driving the LED module is considered to be too low, or lower than a predetermined safe level, then the power converter is forced to continue transferring electric power until the end of the minimum power-ON time. Otherwise, if the output voltage driving the LED module is considered to be sufficient, or higher than a certain level, then the power converter stops transferring power simultaneously at the time when the LED stops emitting light.

Figure 1:
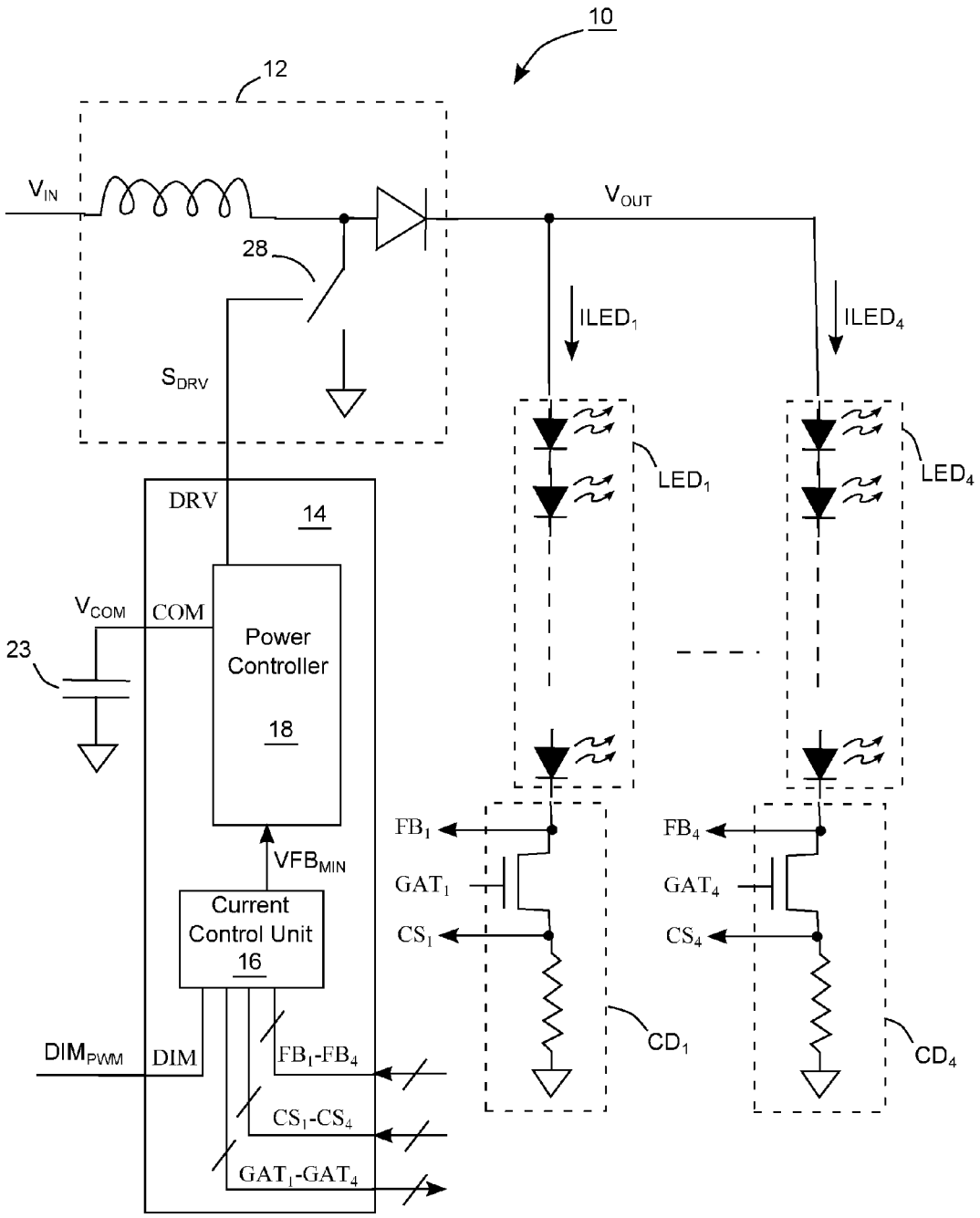
FIG. 1 (PRIOR ART)
FIG. 1 demonstrates a backlight module in the art.

FIG. 1 demonstrates a backlight module 10 in the art, which has four LED modules $LED_1$~$LED_4$ as an example, each LED module comprising LEDs connected in series. Each LED module preferably has, but is not limited to have, the same number of LEDs. A boost converter 12, as an example of a power converter, transfers electric power from input voltage $V_{IN}$ to build output voltage $V_{OUT}$, which powers LED modules $LED_1$~$LED_4$. Driving currents $ILED_1$~$ILED_4$ go through LED modules $LED_1$~$LED_4$, and are controlled by current drivers $CD_1$~$CD_4$ respectively.

Backlight module 10 utilizes PWM dimming, and receives digital dimming signal $DIM_{PWM}$ to control the brightness of LED modules $LED_1$~$LED_4$. Backlight controller 14 includes a power controller 18 in control of boost converter 12, and a current control unit 16 in control of current drivers $CD_1$~$CD_4$. Based on digital dimming signal $DIM_{PWM}$, power controller 18 decides whether booster converter 12 is enabled to convert electric power, and current control unit 16 determines the values of driving currents $ILED_1$~$ILED_4$. Taking LED module $LED_1$ for example, if backlight controller 14 expects to turn it ON, driving currents $ILED_1$ is controlled to be a positive constant independent to the compensation voltage $V_{COM}$. Nevertheless, if backlight controller 14 expects to turn it OFF, then driving current $ILED_1$ is to be about OA. Current control unit 16 forwards to power controller 18 a minimum feedback voltage $VFB_{MIN}$, which corresponds to the minimum of voltages at terminals $FB_1$~$FB_4$.

Figure 2A:
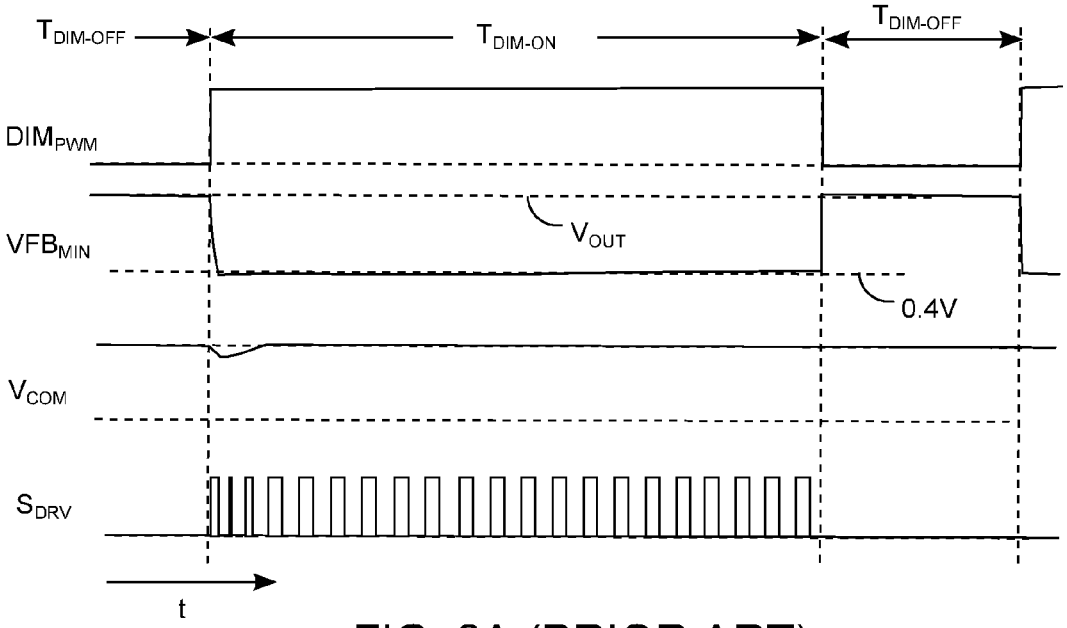
FIG. 2A (PRIOR ART)
FIG. 2A shows some waveforms of signals in FIG. 1.

FIG. 2A shows some waveforms of signals in FIG. 1, comprising from top to bottom, digital dimming signal $DIM_{PWM}$, minimum feedback voltage $VFB_{MIN}$, compensation voltage $V_{COM}$ at pin COM, and control signal $S_{DRV}$ that power controller 18 sends to drive power switch 28. In FIG. 2A, when digital dimming signal $DIM_{PWM}$ is held as "1", LED modules $LED_1$~$LED_4$ emit light, and in the opposite, when digital dimming signal $DIM_{PWM}$ is held as "0", LED modules $LED_1$~$LED_4$ stop emitting light. Even though dimming-ON time $T_{DIM-ON}$ in FIG. 2A refers to the duration when digital dimming signal $DIM_{PWM}$ is "1", and dimming-OFF time $T_{DIM-OFF}$ to the duration when it is "0", it is not necessary to. In this specification, nevertheless, dimming-ON time $T_{DIM-ON}$ refers to the duration when at least one of the LED modules is turned ON to emit light, and dimming-OFF time $T_{DIM-OFF}$ to the duration when all LED modules are turned OFF.

As shown in FIG. 2A, during dimming-OFF time $T_{DIM-OFF}$, control signal $S_{DRV}$ is fixed as "0" such that power switch 28 is turned OFF, and boost converter 12 stops converting electric energy. During dimming-OFF time $T_{DIM-OFF}$, LED modules $LED_1$~$LED_4$ all are turned OFF, driving currents $ILED_1$~$ILED_4$ all are about 0 A, so minimum feedback voltage $VFB_{MIN}$ is about the same as output voltage $V_{OUT}$. Please note the compensation voltage $V_{COM}$ held as unchanged during dimming-OFF time $T_{DIM-OFF}$ Shown in FIG. 2A, control signal $S_{DRV}$ has pulses during dimming-ON time $T_{DIM-ON}$ to switch power switch 28 periodically such that boost converter 12 converts electric power to build up output power $V_{OUT}$, which powers LED modules $LED_1$~$LED_4$ to emit light. Since there is at least one LED module turned ON to emit light during dimming-ON time $T_{DIM-ON}$, minimum feedback voltage $VFB_{MIN}$ drops and remains at a target level, which for example is 0.4V in FIG. 2A. For instance, during dimming-ON time $T_{DIM-ON}$, the difference between minimum feedback voltage $VFB_{MIN}$ and 0.4V is used to adjust compensation voltage $V_{COM}$, which determines the pulse width of a present pulse in control signal $S_{DRV}$. Therefore, the signal path from minimum feedback voltage $VFB_{MIN}$, to compensation voltage $V_{COM}$, control signal $S_{DRV}$, and output voltage $V_{OUT}$, and back to minimum feedback voltage $VFB_{MIN}$ forms a close loop with a negative loop gain. Based on this close loop, compensation voltage $V_{COM}$ is expected to stay stably at a steady voltage, the pulse widths of the pulses of control signal $S_{DRV}$ are modulated, and minimum feedback voltage $VFB_{MIN}$ is regulated to be about 0.4V.

Figure 2B:
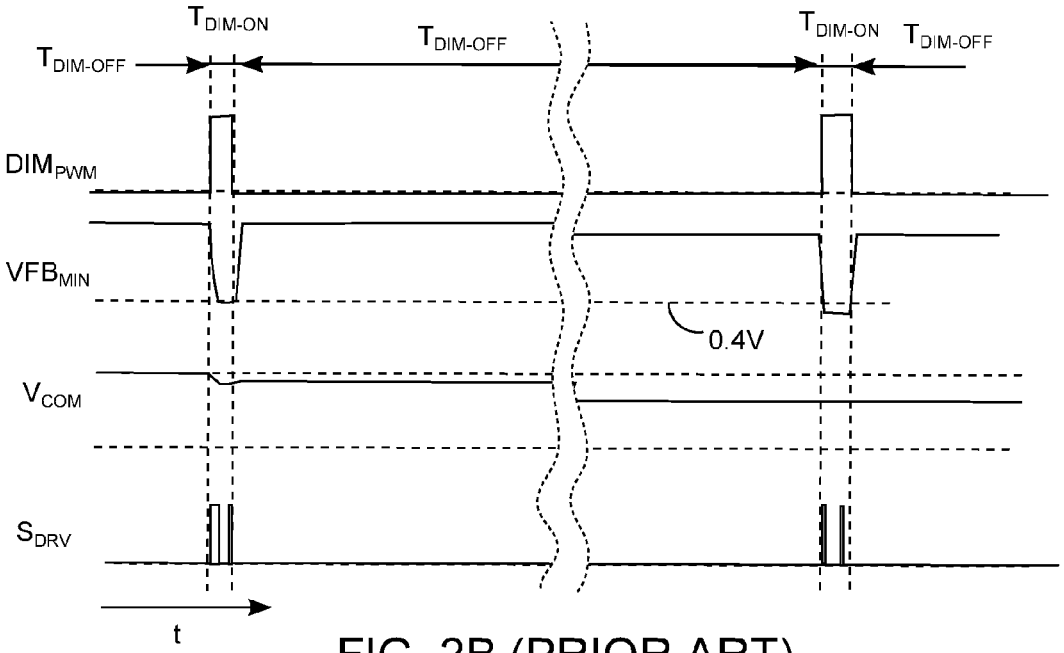
FIG. 2B (PRIOR ART)
FIG. 2B shows some waveforms of signals in FIG. 1 when dimming-ON time $T_{DIM\text{-}ON}$ becomes very short.

FIG. 2B shows some waveforms of signals in FIG. 1 when dimming-ON time $T_{DIM-ON}$ becomes very short. Once dimming-ON time $T_{DIM-ON}$ becomes too short, compensation voltage $V_{COM}$ might not reach its steady voltage before the end of dimming-ON time $T_{DIM-ON}$. Therefore, compensation voltage $V_{COM}$ at the time when the dimming-ON time $T_{DIM-ON}$ ends differs with itself at the time when the dimming-ON time $T_{DIM-ON}$ starts. As shown in the left portion of FIG. 2B, compensation voltage $V_{COM}$ drops a little bit after experiencing one dimming-ON time $T_{DIM-ON}$, and compensation voltage $V_{COM}$ decreases over time as long as the switching cycle of the digital dimming signal $DIM_{PWM}$ increases. The decrement of compensation voltage $V_{COM}$ implies boost converter 12 reduces the power it converts. Eventually, boost converter 12 might not convert enough power to let LED modules $LED_1$~$LED_4$ emit light during a subsequent dimming-ON time $T_{DIM-ON}$. As shown in the right portion of FIG. 2B, during a dimming-ON time $T_{DIM-ON}$, minimum feedback voltage $VFB_{MIN}$ is significantly below the target level, 0.4V, and one of LED modules $LED_1$~$LED_4$ that are expected to emit light during dimming-ON time $T_{DIM-ON}$ might not emit light as a result.

Figure 3:
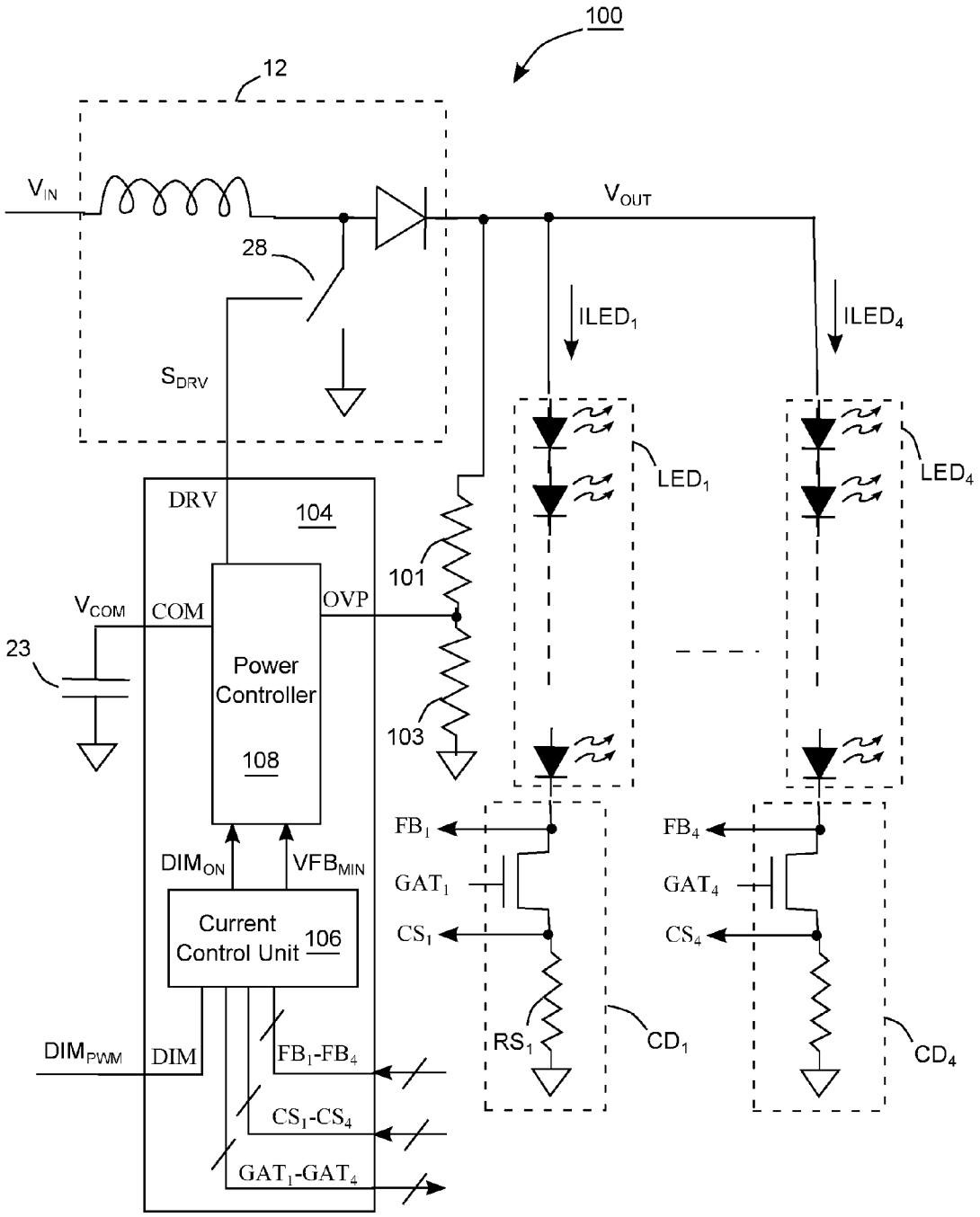
FIG. 3 demonstrates a backlight module according to embodiments of the invention.

FIG. 3 demonstrates a backlight module 100 according to embodiments of the invention. In FIG. 3, the backlight controller 104 could be a packaged integrated circuit with pins DRV, COM, DIM, $FB_1$~$FB_4$, $CS_1$~$CS_4$, $GAT_1$~$GAT_4$ and OVP. Connected to backlight controller 104 are boost converter 12, compensation capacitor 23, LED modules $LED_1$~$LED_4$, current drivers $CD_1$~$CD_4$, voltage-dividing resistors 101 and 103.

Figure 4:
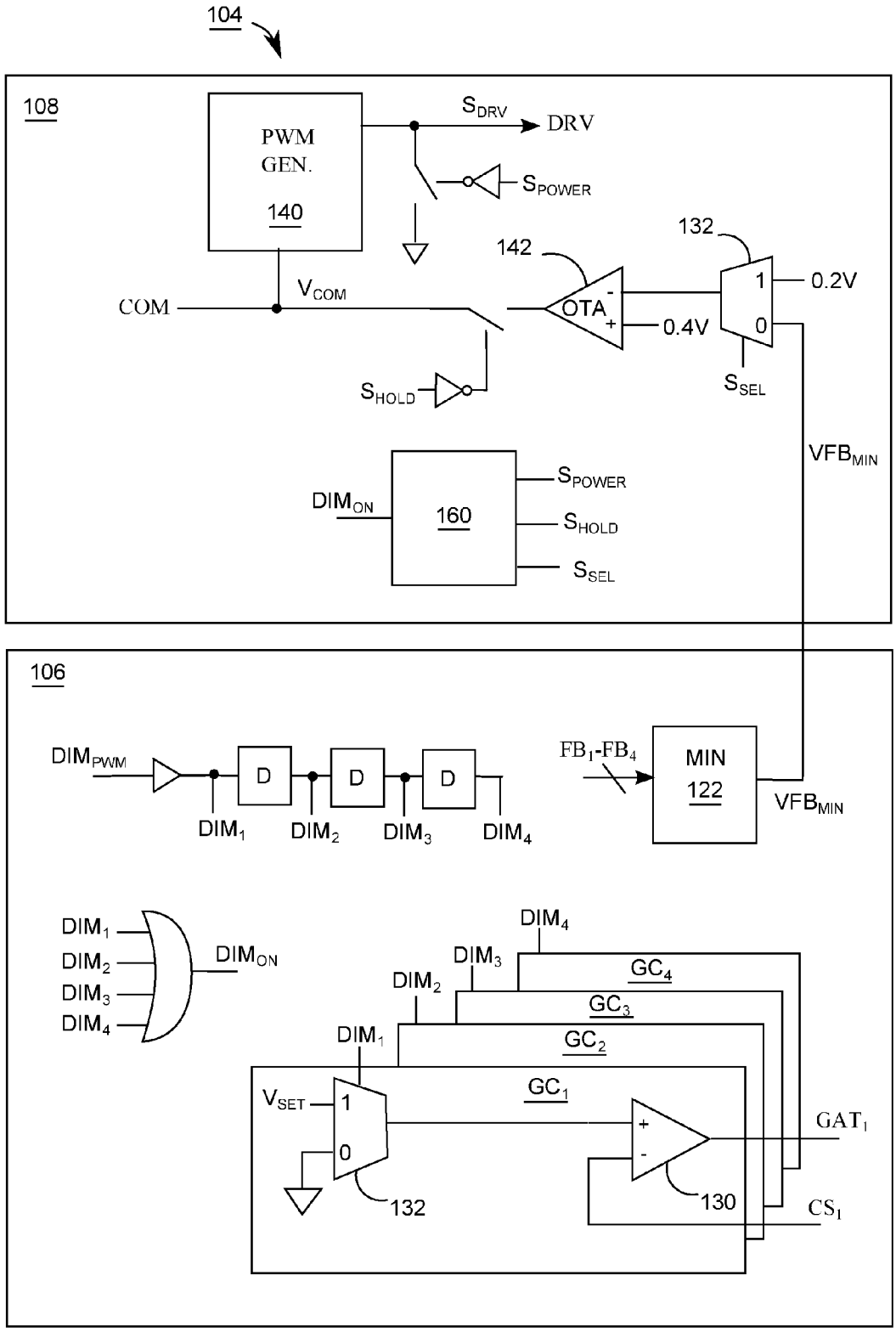
FIG. 4 details the backlight module in FIG. 3.

FIG. 4 details the backlight module 104 in FIG. 3 and has power controller 108 and current control unit 106.

As shown in FIG. 4, current control unit 106 has several delay units D to delay the digital dimming signal $DIM_{PWM}$ and to provide channel-enabled signals $DIM_1$~$DIM_4$. Channel-enabled signals $DIM_1$~$DIM_4$ control gate controllers $GC_1$~$GC_4$ respectively. As gate controllers $GC_1$~$GC_4$ are all alike or the same, only gate controller $GC_1$ is detailed and the rest could be derived based on the teaching regarding to gate controller $GC_1$. Gate controller $GC_1$ includes an operational amplifier 130 and a multiplexer 132. Operational amplifier 130 and current driver $CD_1$ (of FIG. 3) together can determine the value of driving current $ILED_1$. If channel-enabled signal $DIM_1$ is "1" in logic, LED module $LED_1$ is expected to be turned ON, a predetermined voltage $V_{SET}$ (0.2V for example) is selected by multiplexer 132 to forward to operational amplifier 130, and the product of driving current $ILED_1$ and the resistance of current-sense resistor $RS_1$ is about the predetermined voltage $V_{SET}$, so LED module $LED_1$ is turned ON to emit light. In case that channel-enabled signal $DIM_1$ is "0" in logic, multiplexer 132 passes 0V to operational amplifier 130, and driving current $ILED_1$ is about 0 A, so LED module $LED_1$ is turned OFF and does not emit light. Simply put, channel-enabled signal $DIM_1$ could determine whether LED module $LED_1$ is ON or enabled to emit light with a constant brightness.

An OR gate with four inputs connected to channel-enabled signals $DIM_1$~$DIM_4$ outputs a dimming condition signal $DIM_{ON}$. It can be concluded that if anyone of LED modules $LED_1$~$LED_4$ is expected to be turned ON the dimming condition signal $DIM_{ON}$ will be "1" in logic, and if none is turned ON then the dimming condition signal $DIM_{ON}$ will be "0" in logic.

Minimum selector 122 provides minimum feedback voltage $VFB_{MIN}$ based on the minimum of feedback voltages $VFB_1$~$VFB_4$ at pins $FB_1$~$FB_4$ respectively. Minimum feedback voltage $VFB_{MIN}$ could represent one of feedback voltages $VFB_1$~$VFB_4$, and feedback voltage $VFB_1$ for example is a terminal voltage at one end of LED module $LED_1$.

Inside power controller 108, when power-ON signal $S_{POWER}$ is "1" in logic, control signal $S_{DRV}$ is released from being constantly "0", and pulse width modulator (PWM) generator 140 generates pulses with modulated pulse widths to be control signal $S_{DRV}$ at pin DRV. Each pulse width is determined based on the value of compensation voltage $V_{COM}$ at the moment when the pulse is generated. Boost converter 12 converts electric power accordingly. When power-ON signal $S_{POWER}$ is "0" in logic, control signal $S_{DRV}$ is clamped to be at 0V, or "0" in logic, and boost converter 12 stops converting electric power. In other words, power-ON signal $S_{POWER}$ presents whether boost converter 12 is allowed to convert power to power LED modules $LED_1$~$LED_4$.

Power controller 108 also has an operational transcoductance amplifier (OTA) 142. Connected between OTA 142 and pin COM is a switch controlled by hold signal $S_{HOLD}$. Hold signal $S_{HOLD}$, if it is "0", causes the switch a short circuit, so OTA 142 can charge/discharge compensation capacitor 23 to change compensation voltage $V_{COM}$. Nevertheless, if it is "1", then the switch is an open circuit, output of OTA 142 is isolated from compensation capacitor 23, so compensation voltage $V_{COM}$ is held as unchanged.

Selection signal $S_{SEL}$ controls multiplexer 132 to pass either 0.2V or minimum feedback voltage $VFB_{MIN}$ to an inverted input of OTA 142.

When selection signal $S_{SEL}$, hold signal $S_{HOLD}$, and power-ON signal $S_{POWER}$ are "0", "0", and "1" respectively, the signal path passing through minimum feedback voltage $VFB_{MIN}$, to compensation voltage $V_{COM}$, control signal $S_{DRV}$, output voltage $V_{OUT}$ and back to minimum feedback voltage $VFB_{MIN}$ can form a close loop, based on which power controller 108 lets power converter 12 convert and provide electric power to LED modules $LED_1$~$LED_4$, in order to regulate minimum feedback voltage to be about 0.4V. This close loop could be broken and becomes an open loop if selection signal $S_{SEL}$ is "1", hold signal $S_{HOLD}$ "1" or power-ON signal $S_{POWER}$ "0".

State controller 160 determines the logic values of selection signal $S_{SEL}$, hold signal $S_{HOLD}$, and power-ON signal $S_{POWER}$, based on dimming condition signal $DIM_{ON}$. It is implied that state controller 160 determines whether the close loop forms or disappears.

Figure 5A:
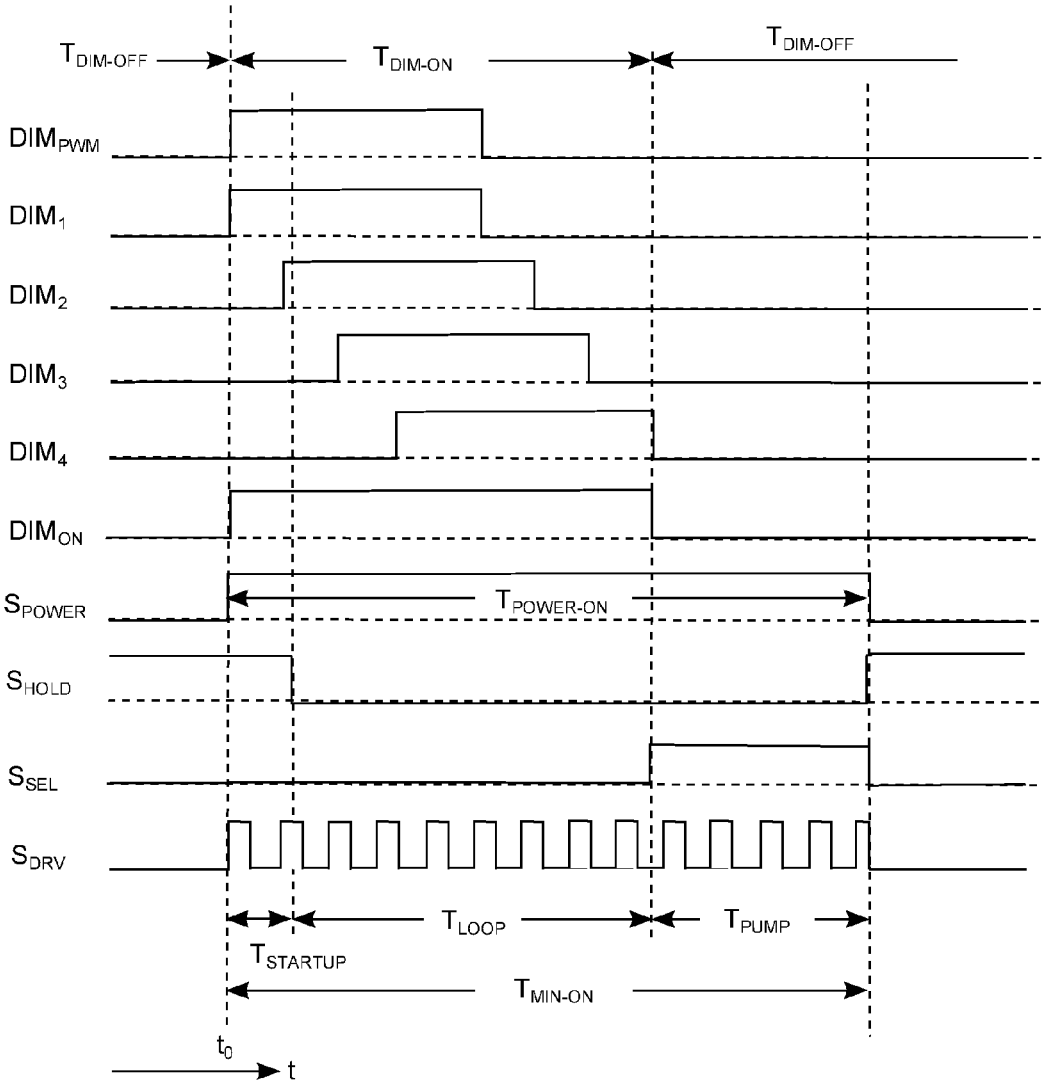
FIG. 5A shows some waveforms of signals in FIG. 4 when dimming-ON time $T_{DIM\text{-}ON}$ is less than a predetermined minimum power-ON time $T_{MIN\text{-}ON}$.

FIG. 5A shows some waveforms of signals in FIG. 4 when dimming-ON time $T_{DIM\text{-}ON}$ is less than a predetermined minimum power-ON time $T_{MIN\text{-}ON}$. Waveforms shown in FIG. 5A are, from top to bottom, digital dimming signal $DIM_{PWM}$, channel-enabled signals $DIM_1$~$DIM_4$, dimming condition signal $DIM_{ON}$, power-ON signal $S_{POWER}$, hold signal $S_{HOLD}$, selection signal $S_{SEL}$ and control signal $S_{DRV}$.

Derivable from FIGS. 4 and 5A, channel-enabled signals $DIM_1$~$DIM_4$ are generally equivalent to digital dimming signal $DIM_{PWM}$. They share substantially the same waveform but have different time delays. Dimming condition signal $DIM_{ON}$ is the output result of an OR gate with inputs of channel-enabled signals $DIM_1$~$DIM_4$, as shown in FIG. 5A. Dimming-ON time $T_{DIM\text{-}ON}$ is the duration when dimming condition signal $DIM_{ON}$ is "1". As defined in advance, during dimming-ON time $T_{DIM\text{-}ON}$, at least one LED module is expected to be turned ON, emitting light. In the opposite, a dimming-OFF time $T_{DIM\text{-}OFF}$ is a duration when dimming condition signal $DIM_{ON}$ is "0", or the duration when no LED module is turned ON to emit light. As a result, digital dimming signal $DIM_{PWM}$ determines the waveform of dimming condition signal $DIM_{ON}$.

Demonstrated in FIG. 5A, in the beginning, digital dimming signal $DIM_{PWM}$, channel-enabled signals $DIM_1$~$DIM_4$, dimming condition signal $DIM_{ON}$, power-ON signal $S_{POWER}$, selection signal $S_{SEL}$, and control signal $S_{DRV}$ are all "0", but hold signal $S_{HOLD}$ is "1". In the meantime, no LED module is driven or emits light, compensation voltage $V_{COM}$ is held as unchanged, and boost converter 12 does not convert electric power.

At time point $t_0$, digital dimming signal $DIM_{PWM}$ switches to be "1", so dimming condition signal $DIM_{ON}$ becomes "1" accordingly to announce the beginning of dimming-ON time $T_{DIM\text{-}ON}$. Shown in FIG. 5A, state controller 160 predetermines two periods of time, one is startup time $T_{STARTUP}$ and the other minimum power-ON time $T_{MIN\text{-}ON}$, both starting from the beginning of the dimming-ON time $T_{DIM\text{-}ON}$. Nevertheless, minimum power-ON time $T_{MIN\text{-}ON}$ ends later than startup time $T_{STARTUP}$ does. In other words, minimum power-ON time $T_{MIN\text{-}ON}$ is longer than startup time $T_{STARTUP}$.

During startup time $T_{STARTUP}$, power-ON signal $S_{POWER}$, hold signal $S_{HOLD}$, and selection signal $S_{SEL}$ are "1", "1" and "0" respectively. It implies that compensation voltage $V_{COM}$ is held as unchanged, and boost converter 12 converts electric power to power LED modules $LED_1$~$LED_4$ based on this held compensation voltage $V_{COM}$. Please note that the close loop for regulating minimum feedback voltage $VFB_{MIN}$ does not form during startup time $T_{STARTUP}$. Introducing startup time $T_{STARTUP}$ is beneficial in reducing the influence of unstable minimum feedback voltage $VFB_{MIN}$ at the beginning of dimming-ON time $T_{DIM\text{-}ON}$. As illustrated in FIGS. 2A and 2B, at the beginning of dimming-ON time $T_{DIM\text{-}ON}$, minimum feedback voltage $VFB_{MIN}$, which stayed at a relatively high level in a previous dimming-OFF time $T_{DIM\text{-}OFF}$, drops abruptly. During startup time $T_{STARTUP}$, compensation voltage $V_{COM}$ is held as unchanged so that the abrupt change of minimum feedback voltage $VFB_{MIN}$ could not wrongly influence compensation voltage $V_{COM}$.

FIG. 5A defines close-loop time $T_{LOOP}$ as the duration starting at the end of startup time $T_{STARTUP}$ and ending at the end of dimming-ON time $T_{DIM\text{-}ON}$. During close-loop time $T_{LOOP}$, power-ON signal $S_{POWER}$, hold signal $S_{HOLD}$, and selection signal $S_{SEL}$ are "1", "0" and "0" respectively. Therefore, the signal path passing through minimum feedback voltage $VFB_{MIN}$, to compensation voltage $V_{COM}$, control signal $S_{DRV}$, output voltage $V_{OUT}$ and back to minimum feedback voltage $VFB_{MIN}$ forms a close loop, based on which power controller 108 lets power converter 12 convert and provide electric power to LED modules $LED_1$~$LED_4$, in order to regulate minimum feedback voltage to be about 0.4V.

FIG. 5A also defines pump time $T_{PUMP}$ as the duration starting at the end of dimming-ON time $T_{DIM\text{-}ON}$ and ending at the end of minimum power-ON time $T_{MIN\text{-}ON}$. During pump time $T_{PUMP}$, power-ON signal $S_{POWER}$, hold signal $S_{HOLD}$, and selection signal $S_{SEL}$ are "1", "0" and "1" respectively. The close loop, which formed during close-loop time $T_{LOOP}$, is open now because selection signal $S_{SEL}$ with logic value of "1" causes multiplexer 132 in FIG. 4 to forward 0.2V to OTA 142. A constant difference, equal to 0.4V minus 0.2V, between the inputs of OTA 142 is introduced in the meantime, so OTA 142 outputs a constant current and charges compensation capacitor 23, rising compensation voltage $V_{COM}$. Even though none of LED modules emit light during pump time $T_{PUMP}$, boost converter 12 continues converting power to build output voltage $V_{OUT}$ according to the risen compensation voltage $V_{COM}$.

Figure 5B:
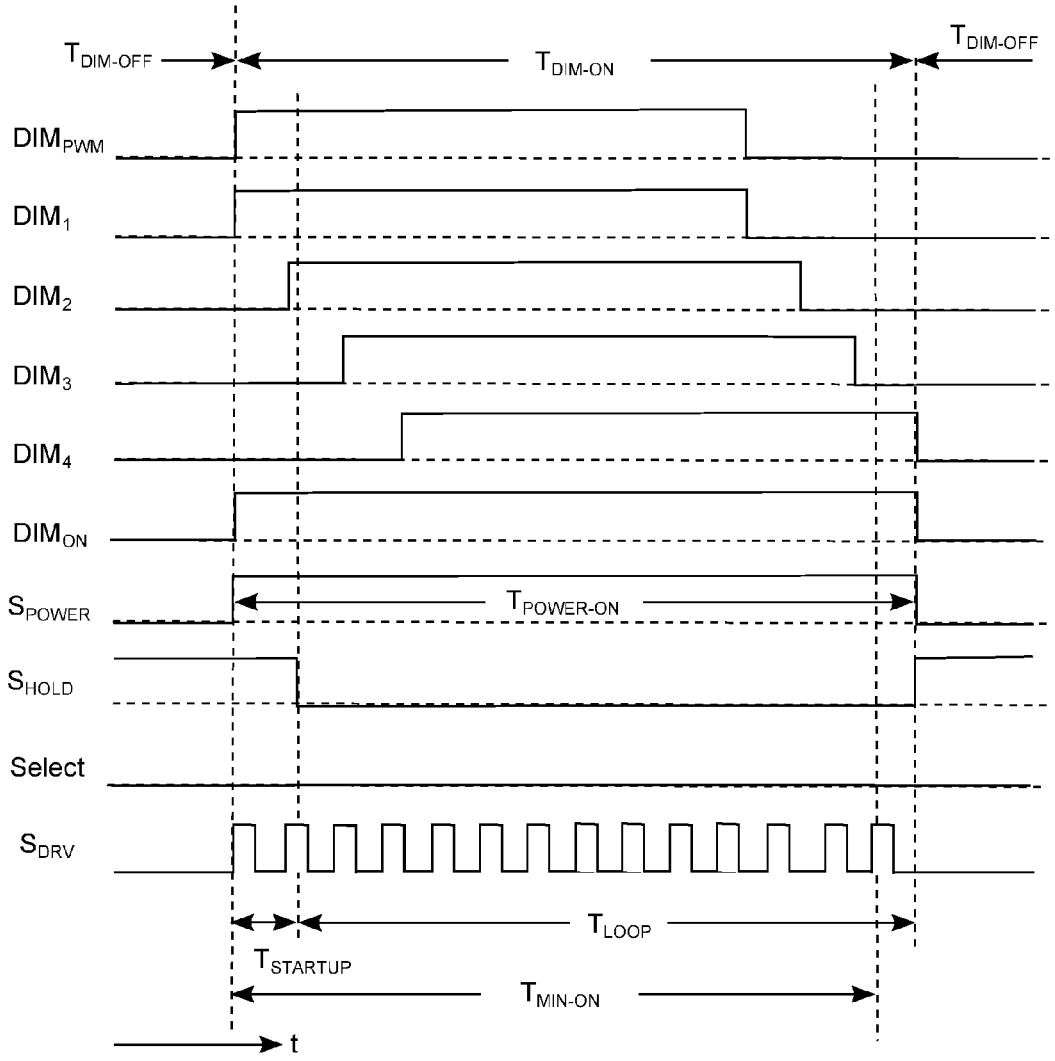
FIG. 5B shows some waveforms of signals in FIG. 4 when dimming-ON time $T_{DIM\text{-}ON}$ exceeds minimum power-ON time $T_{MIN\text{-}ON}$.

In FIG. 5A, when minimum power-ON time $T_{MIN\text{-}ON}$ ends, power-ON signal $S_{POWER}$, hold signal $S_{HOLD}$, and selection signal $S_{SEL}$ become "0", "1" and "0" respectively, returning back to the original states before the beginning of dimming-ON time $T_{DIM\text{-}ON}$. A power-ON time $T_{POWER\text{-}ON}$ is defined as the duration when power-ON signal $S_{POWER}$ is "1", or the duration when boost converter 12 is enabled to convert power. As shown in FIG. 5A, dimming-ON time $T_{DIM\text{-}ON}$ is less than minimum power-ON time $T_{MIN-ON}$, so pump time $T_{PUMP}$ follows dimming-ON time $T_{DIM-ON}$, and power-ON time $T_{POWER-ON}$ is about equal to minimum power-ON time $T_{MIN-ON}$ FIG. 5B shows some waveforms of signals in FIG. 4 when dimming-ON time $T_{DIM-ON}$ exceeds minimum power-ON time $T_{MIN-ON}$. The similarity between FIGS. 5A and 5B is understandable based on the previous teaching regarding to FIG. 5A, and is omitted hereinafter for brevity. Nevertheless, unlike FIG. 5A, which shows a much shorter dimming-ON time $T_{DIM-ON}$, FIG. 5B shows a dimming-ON time $T_{DIM-ON}$ longer than minimum power-ON time $T_{MIN-ON}$. Accordingly, FIG. 5B does not show pump time $T_{PUMP}$, which as defined in FIG. 5A starts at the end of dimming-ON time $T_{DIM-ON}$ and stops at the end of minimum power-ON time $T_{MIN-ON}$. In FIG. 5B, power-ON time $T_{POWER-ON}$ is about equal to dimming-ON time $T_{DIM-ON}$.

Figure 6:
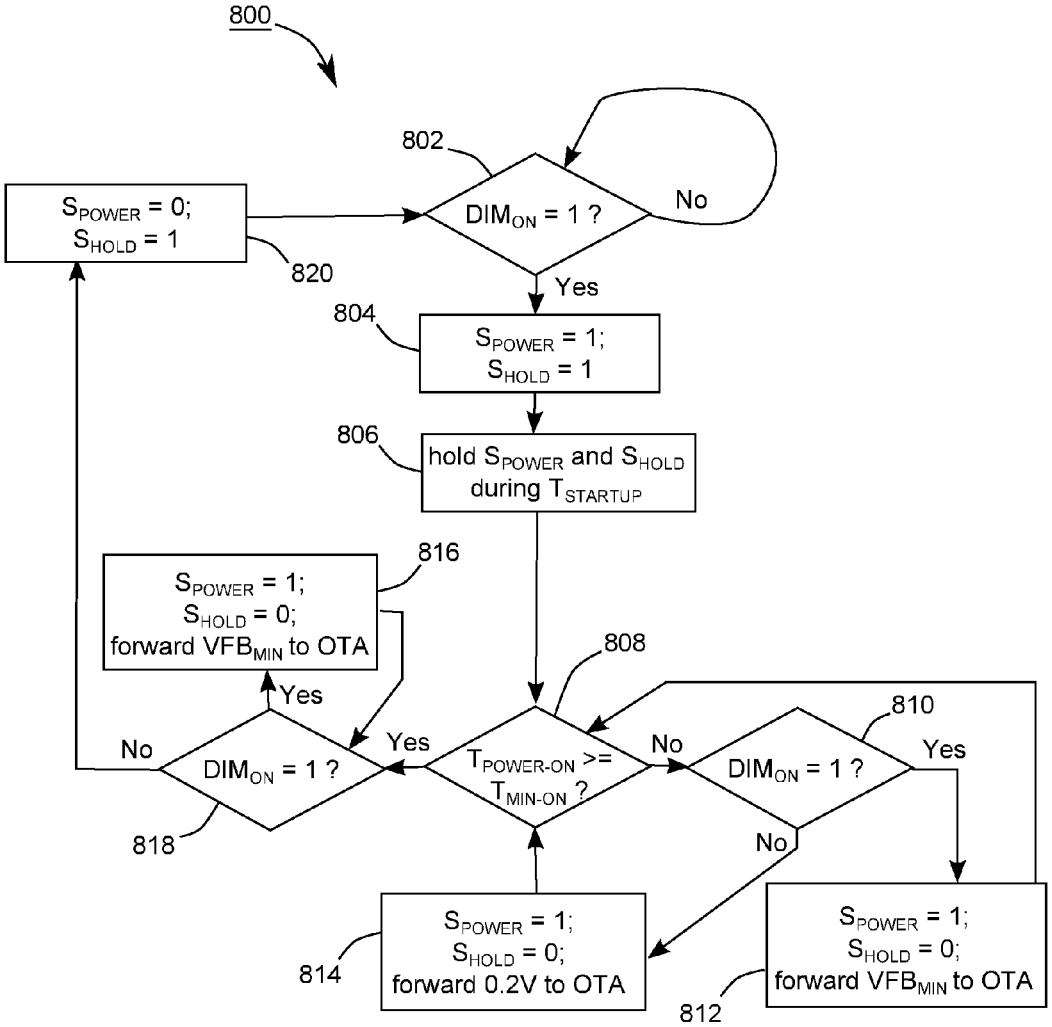
FIGS. 6 and 7 show two flow charts for generating power-ON signal $S_{POWER}$, hold signal $S_{HOLD}$, and selection signal $S_{SEL}$, both suitable for the use in a state controller.

FIG. 6 shows a flow chart 800 for generating power-ON signal $S_{POWER}$, hold signal $S_{HOLD}$, and selection signal $S_{SEL}$, suitable for the use in state controller 160.

Step 802 checks whether digital dimming signal $DIM_{ON}$ is "1". If digital dimming signal $DIM_{ON}$ is "0", power-ON signal $S_{POWER}$ and hold signal $S_{HOLD}$ are held as "0" and "1" respectively, so boost converter 12 is not converting electric power and compensation voltage $V_{COM}$ is held as unchanged. Otherwise, if digital dimming signal $DIM_{ON}$ is "1", steps 804 and 806 follow.

Step 804 set both power-ON signal $S_{POWER}$ and hold signal $S_{HOLD}$ to be "1", meaning the beginning of power-ON time $T_{POWER-ON}$ and the continuous hold of compensation voltage $V_{COM}$. Step 806 holds the logic values of power-ON signal $S_{POWER}$, hold signal $S_{HOLD}$, and selection signal $S_{SEL}$ until the end of startup time $T_{STARTUP}$.

Step 808 follows step 806, checking whether power-ON time $T_{POWER-ON}$ has exceeded minimum power-ON time $T_{MIN-ON}$. A negative result from step 808 makes step 810 follow, and step 810 checks if dimming condition signal $DIM_{ON}$ is "1". If power-ON time $T_{POWER-ON}$ is less than minimum power-ON time $T_{MIN-ON}$ and dimming condition signal $DIM_{ON}$ is "1", it means backlight module 100 should be operating in close-loop time $T_{LOOP}$, so step 812 follows to set power-ON signal $S_{POWER}$, hold signal $S_{HOLD}$, and selection signal $S_{SEL}$ as "1", "0", and "0" respectively. In case that power-ON time $T_{POWER-ON}$ is still less than minimum power-ON time $T_{MIN-ON}$ but dimming condition signal $DIM_{ON}$ has changed into "0", then it means backlight module 100 should be operating in pump time $T_{PUMP}$, so in step 814 power-ON signal $S_{POWER}$, hold signal $S_{HOLD}$, and selection signal $S_{SEL}$ are set to be "1", "0", and "1" respectively. Step 808 also follows steps 814 and 812, continuously checking if power-ON time $T_{POWER-ON}$ has exceeded minimum power-ON time $T_{MIN-ON}$.

Once power-ON time $T_{POWER-ON}$ exceeds minimum power-ON time $T_{MIN-ON}$, step 818 follows, checking if dimming condition signal $DIM_{ON}$ is "1". In the meantime, dimming condition signal $DIM_{ON}$ with a logic value of "1" means backlight module 100 should be operating in close-loop time $T_{LOOP}$, so step 816, which is the same with step 812, follows to set power-ON signal $S_{POWER}$, hold signal $S_{HOLD}$, and selection signal $S_{SEL}$ as "1", "0", and "0" respectively. If dimming condition signal $DIM_{ON}$ changes to be "0" after power-ON time $T_{POWER-ON}$ has exceeded minimum power-ON time $T_{MIN-ON}$, step 820 follows to set power-ON signal $S_{POWER}$ "0" and hold signal $S_{HOLD}$ "1", resetting these signals back to what they were before the beginning of dimming-ON time $T_{DIM-ON}$. Step 802 follows step 820.

Based on the teaching of FIG. 6, it is concluded that the operation during startup time $T_{STARTUP}$ is performed by steps 804 and 806, the operation during pump time $T_{PUMP}$ is performed by step 814, and the operation during close-loop time $T_{LOOP}$ is performed by steps 816 and 812.

Derivable from FIGS. 5A and 5B, power-ON time $T_{POWER-ON}$ is at least equal to minimum power-ON time $T_{MIN-ON}$. If dimming-ON time $T_{DIM-ON}$ is so short, then state controller 104 automatically adds pump time $T_{PUMP}$ after startup time $T_{STARTUP}$ and close-loop time $T_{LOOP}$, to expand power-ON time $T_{POWER-ON}$ and make it equal to minimum power-ON time $T_{MIN-ON}$, as shown in FIG. 5A. If dimming-ON time $T_{DIM-ON}$ is long enough to has power-ON time $T_{POWER-ON}$ longer than minimum power-ON time $T_{MIN-ON}$, then pump time $T_{PUMP}$ is unnecessary, disappearing as demonstrated in FIG. 5B.

The insertion of pump time $T_{PUMP}$ could avoid flickering caused by a too-short dimming-ON time $T_{DIM-ON}$. During pump time $T_{PUMP}$, power converter 102 lacks the information of minimum feedback voltage $VFB_{MIN}$, and blindly converts excess electric power, even though LED modules are not emitting light. The excess electric power will be accumulated in the output node of power converter 102, so LED modules $LED_1$~LED4 could have enough electric power to properly emit light in subsequent dimming-ON times $T_{DIM-ON}$.

Unfortunately, the excess electric power might cause output voltage $V_{OUT}$ over high and damage to current driver $CD_1$~$CD_4$. In one embodiment of the invention, power controller 108 in FIG. 3 detects output voltage $V_{OUT}$ via voltage-dividing resistors 101 and 103. If output voltage $V_{OUT}$ is found to be over high, exceeding a predetermined value, then an over-voltage protection is triggered, so power controller 108 forces power-ON signal $S_{POWER}$ to be "0" and power conversion by power converter 102 stops. Meanwhile, current control unit 106 is still allowed to control driving currents $ILED_1$~$ILED_4$ in response to digital dimming signal $DIM_{PWM}$. For example, if over-voltage protection is triggered, then pump time $T_{PUMP}$ is forbidden to be added even if dimming-ON time $T_{DIM-ON}$ is very short. Adding of pump time $T_{PUMP}$ could be resumed when over-voltage protection is released or output voltage $V_{OUT}$ has dropped down to a certain safe level.

In FIG. 4, the logic value of selection signal $S_{SEL}$ has no impact to compensation voltage $V_{OUT}$ when hold voltage $S_{HOLD}$ is "1", because OTA 142 is isolated from compensation capacitor 23. For instance, during startup time $T_{STARTUP}$ in FIG. 5A or 5B, selection signal $S_{SEL}$ is not limited to be "0", and could be "1" instead.

In another embodiment of the invention, during minimum power-ON time $T_{MIN-ON}$, the non-inverted input of OTA 142 in FIG. 4 receives 0.8V rather than 0.4V. Accordingly, close-loop time $T_{LOOP}$, if long enough, could consist of two portions, separated by the end of minimum power-ON time $T_{MIN-ON}$. During the front portion, the close loop regulates minimum feedback voltage $VFB_{MIN}$ to be 0.8V, and during the rear portion, the same close loop regulates it to be 0.4V.

Some embodiments of the invention might not limit power-ON time $T_{POWER-ON}$ to be not less than minimum power-ON time $T_{MIN-ON}$ all the time. For example, under some predetermined conditions, pump time $T_{PUMP}$ might not appear even though dimming-ON time $T_{DIM-ON}$ is shorter than minimum power-ON time $T_{MIN-ON}$.

Figure 7:
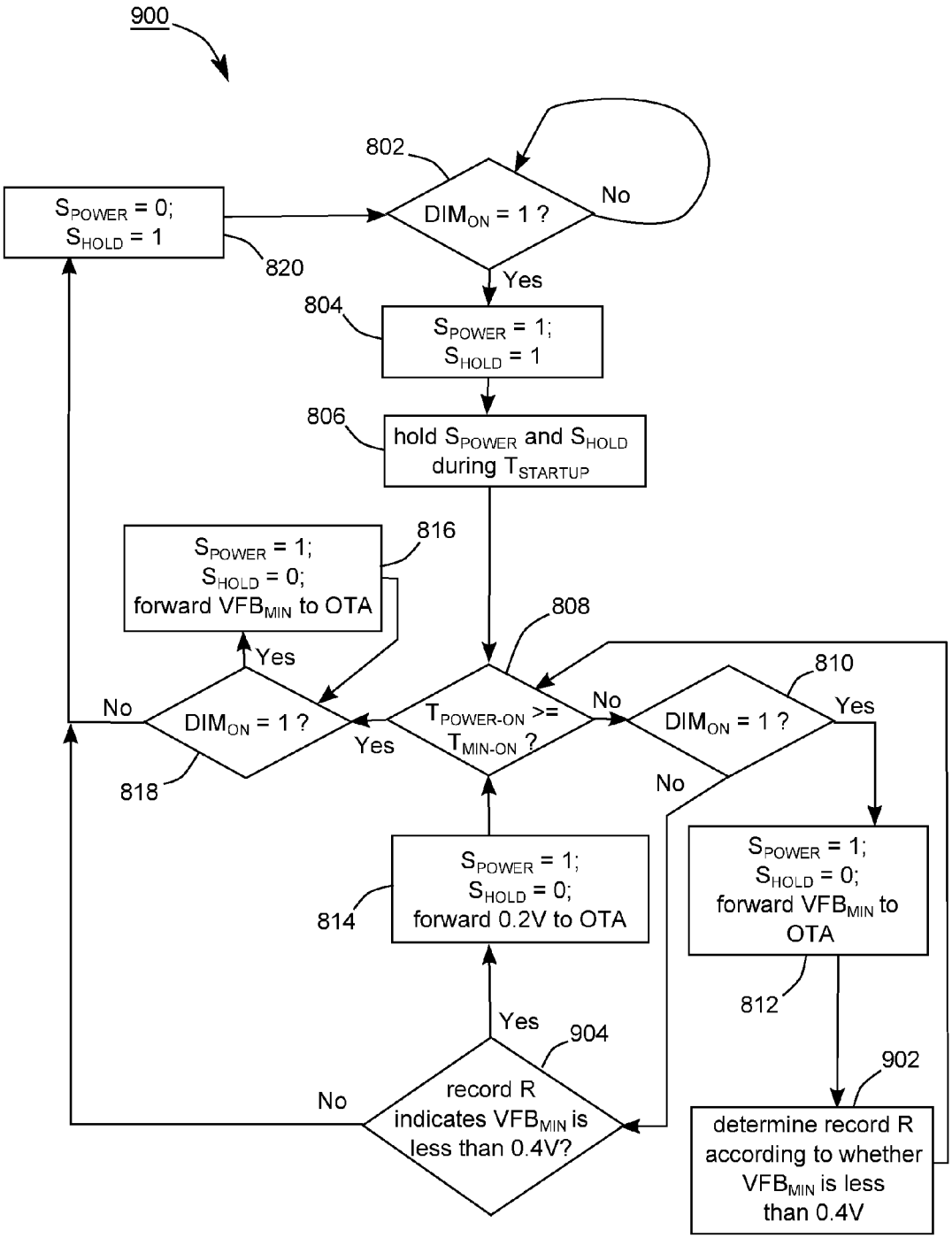

FIG. 7 shows another flowchart 900 for generating power-ON signal $S_{POWER}$, hold signal $S_{HOLD}$, and selection signal $S_{SEL}$, also suitable for the use in state controller 160 of FIG. 4. Comparing with the flow chart in FIG. 6, flow chart 900 further has steps 902 and 904, where step 902 follows step 812 and step 904 follows a negative result of step 810. Both steps 902 and 904 are performed during close-loop time $T_{LOOP}$. Step 902 checks whether minimum feedback voltage $VFB_{MIN}$ is below 0.4V and make a record R accordingly. For example, record R is "1" if minimum feedback voltage $VFB_{MIN}$ exceeds 0.4V, and is "0" otherwise. The record R with "1" implies that output voltage $V_{OUT}$ is high enough to drive LED modules $LED_1$~$LED_4$ in a proper manner. In the opposite, the record R with "0" could indicate that output voltage $V_{OUT}$ is too low to drive LED modules $LED_1$~$LED_4$ properly.

Step 904 follows step 810, determining whether pump time $T_{PUMP}$ is going to appear. If the record R decided in step 902 shows that minimum feedback voltage $VFB_{MIN}$ is below 0.4V, then step 814 follows step 904 to elongate power-ON time $T_{POWER-ON}$, so pump time $T_{PUMP}$ appears to boost output voltage $V_{OUT}$. Otherwise, if the record R decided in step 902 indicates that minimum feedback voltage $VFB_{MIN}$ is above 0.4V, then step 820 follows step 904 to immediately terminate power-ON time $T_{POWER-ON}$, and pump time $T_{PUMP}$ is skipped. Obviously, if the flow goes from step 904 to step 820, power-ON time $T_{POWER-ON}$ is shorter than minimum power-ON time $T_{MIN-ON}$. In other words, flow chart 900 allows power-ON time $T_{POWER-ON}$ to be less than minimum power-ON time $T_{MIN-ON}$.

Flow chart 900 in FIG. 7 teaches that a detection result, the record R, made during close-loop time $T_{LOOP}$ is employed later to decide whether pump time $T_{PUMP}$ is added. In comparison with flow chart 800 in FIG. 6, flow chart 900 could have high conversion efficiency and avoid the event of over high output voltage $V_{OUT}$.

Beside minimum feedback voltage $VFB_{MIN}$, there are other signals capable of indicating whether output voltage $V_{OUT}$ is high enough to drive LED modules $LED_1$~$LED_4$ properly. For instance, during close-loop time $T_{LOOP}$, if any of the voltages at pin $GAT_1$~$GAT_4$ (of FIG. 3) exceeds a predetermined safe level, then output voltage $V_{OUT}$ could be deemed too low to drive LED modules $LED_1$~$LED_4$. The voltages at pin $GAT_1$~$GAT_4$ are the gate voltages of the NMOS transistors in current drivers $CD_1$~$CD_4$, where each of the NMOS transistors is a voltage-controllable current source.

While the invention has been described by way of example and in terms of preferred embodiment, it is to be understood that the invention is not limited thereto. To the contrary, it is intended to cover various modifications and similar arrangements (as would be apparent to those skilled in the art) . Therefore, the scope of the appended claims should be accorded the broadest interpretation so as to encompass all such modifications and similar arrangements.

What is claimed is:

1. A control method for light dimming, comprising:

providing a dimming condition signal, wherein a first logic value of the dimming condition signal represents a light emitting device is expected to be emitting light, and a second logic value of the dimming condition signal represents the light emitting device is expected not to be emitting light, wherein the duration when the dimming condition signal is at the first logic value is a dimming-ON time;

providing, in the dimming-ON time, a close loop to make a power converter convert electric energy to the light emitting device such that the light emitting device is capable of emitting light, wherein a power-ON time is the duration when the power converter converts electric energy to the light emitting device; and continuing, when the dimming condition signal is switched to be at the second logic value and the dimming-ON time is less than a minimum power-ON time, the power converter converting the electric energy to the light emitting device so as to keep the power-ON time not less than the minimum power-ON time.

2. The control method of claim 1, wherein the step of continuing comprises:

making the close loop open; and providing a constant current to charge/discharge a compensation capacitor such that a compensation voltage at the compensation capacitor is changed;

wherein the power converter provides electric energy to the light emitting device based on the compensation voltage.

3. The control method of claim 1, further comprising:

making, when the dimming condition signal is switched to be at the second logic value and the dimming-ON time exceeds the minimum power-ON time, the close loop open, and stopping providing electric energy to the light emitting device.

4. The control method of claim 1, further comprising:

receiving a digital dimming signal;

in response to the digital dimming signal, generating channel-enabled signals to control light emitting devices respectively; and providing the dimming condition signal in response to the channel-enabled signals.

5. The control method of claim 4, comprising:

delaying the digital dimming signal to generate one of the channel-enabled signals.

6. The control method of claim 1, comprising:

making, during a startup time after a beginning of the dimming-ON time, the close loop open, and making the power converter convert electric energy to the light emitting device;

wherein the startup time is shorter than the minimum power-ON time.

7. The control method of claim 6, wherein during the startup time, a compensation voltage at a compensation capacitor is held as unchanged.

8. The control method of claim 1, comprising:

detecting, in the dimming-ON time, a driving signal driving the light emitting device to generate a record;

continuing, when the dimming condition signal is switched to be at the second logic value, the dimming-ON time is less than a minimum power-ON time, and the record is a first value, converting the electric energy to the light emitting device for keeping the power-ON time not less than the minimum power-ON time; and stopping, when the dimming condition signal is switched to be at the second logic value, the dimming-ON time is less than a minimum power-ON time, and the record is a second value different with the first value, converting the electric energy to the light emitting device.

9. The control method of claim 1, wherein the driving signal is a driving voltage at an end terminal of the light emitting device.

10. The control method of claim 1, wherein the driving signal is a control voltage at a control terminal of a voltage-controllable current source.

11. The control method of claim 1, further comprising:

detecting an output voltage of the power converter; and stopping, when the output voltage exceeds a predetermined value, the power converter converting the electric energy to the light emitting device.

12. The control method of claim 1, wherein the light emitting device comprises a light emitting diode.

13. The control method of claim 1, wherein the duration when the close loop is provided is a close-loop time, the duration when the dimming condition signal is at the second logic value and the power converter continues converting the electric energy to the light emitting device is a pump time, and the pump time continuously follows the close-loop time.

14. A back-light controller, comprising:

a current control unit, receiving a digital dimming signal to generate a dimming condition signal and to control a driving current through a light emitting device, wherein, when the dimming condition signal is at a first logic value the driving current is about 0, and when the diming condition signal is at a second logic value different from the first logic value the driving current is about a constant more than 0, wherein the duration when the dimming condition signal is at the first logic value is a dimming-ON time; and a power controller for controlling a power converter to convert electric power to the light emitting device, wherein the duration when the power converter converts the electric energy to the light emitting device is a power-ON time;

wherein, when the dimming condition signal is at the first logic value, the power controller provides a close loop and the power converter converts, based on the close loop, the electric energy to the light emitting device such that the light emitting device is capable of emitting light; and when the dimming condition signal is switched to be at the second logic value and the dimming-ON time is less than a minimum power-ON time, the power converter continues converting the electric energy to the light emitting device for elongating the power-ON time to be not less than the minimum power-ON time.

15. The backlight controller of claim 14, wherein the duration when the close loop is provided is a close-loop time, the duration when the dimming condition signal is at the second logic value and the power converter continues providing the electric energy to the light emitting device is a pump time, and the pump time follows the close-loop time.

16. The backlight controller of claim 15, wherein during the pump time, the current control unit provides a constant current to charge/discharge a compensation capacitor such that electric power delivered from the power converter to the light emitting device increases.

17. The backlight controller of claim 15, wherein during the close-loop time, based on a driving signal to the light emitting device, the power controller generates a record;

when the dimming condition signal is switched to be at the second logic value, the dimming-ON time is less than a minimum power-ON time, and the record is a first value, the pump time follows the close-loop time; and when the dimming condition signal is switched to be at the second logic value, the dimming-ON time is less than a minimum power-ON time, and the record is a second value, the power converter is stopped from converting the electric energy to the light emitting device.

* * * * *